US010464275B2

(12) United States Patent
Spiesshofer

(10) Patent No.: US 10,464,275 B2
(45) Date of Patent: Nov. 5, 2019

(54) USING DATA ABOUT THE FORCE FLOW IN A PRESS FOR THE OPERATION OF A RAM

(71) Applicant: SCHULER PRESSEN GMBH, Goeppingen (DE)

(72) Inventor: Thomas Spiesshofer, Bermatingen (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 1319 days.

(21) Appl. No.: 14/372,217

(22) PCT Filed: Jan. 15, 2013

(86) PCT No.: PCT/DE2013/100008
§ 371 (c)(1),
(2) Date: Oct. 23, 2014

(87) PCT Pub. No.: WO2013/107444
PCT Pub. Date: Jul. 25, 2013

(65) Prior Publication Data

US 2015/0047517 A1 Feb. 19, 2015

(30) Foreign Application Priority Data

Jan. 16, 2012 (DE) ..... 10 2012 100 325

(51) Int. Cl.
*B30B 15/00* (2006.01)
*B30B 15/16* (2006.01)
(Continued)

(52) U.S. Cl.
CPC ..... *B30B 15/165* (2013.01); *B30B 1/28* (2013.01); *B30B 15/0094* (2013.01); *B30B 15/24* (2013.01)

(58) Field of Classification Search
CPC ..... B30B 15/165; B30B 1/28; B30B 15/0094; B30B 15/24; B30B 15/14; B30B 15/00; B30B 1/26
(Continued)

(56) References Cited

U.S. PATENT DOCUMENTS 3,407,913 A 10/1968 Yoshitomo
5,243,902 A 9/1993 Plazenet
(Continued)

FOREIGN PATENT DOCUMENTS

AT 215 257 B 5/1961
DE 1 577 202 A1 2/1970
(Continued)

OTHER PUBLICATIONS http://www.thepunctuationguide.com/slash.html. printed Nov. 27, 2018.*

*Primary Examiner* — Ghassem Alie
*Assistant Examiner* — Nhat Chieu Q Do
(74) *Attorney, Agent, or Firm* — Norman B. Thot

(57) ABSTRACT

A method of using data on the force flow in a press for the operation of a plunger, wherein the loads of the parts involved in the force flow can differ as a result of eccentrically operating forces, in such a way that the data about the respectively acting forces that, in accordance with Hooke's law, cause an extension or compression of a movement of the parts involved in the force flow, is measured and evaluated in relation to a drive device and a position of the plunger, whereupon a skewed position of the plunger is permitted or a skewed position of the plunger is counteracted or a skewed position of the plunger is set during operation of the press.

10 Claims, 2 Drawing Sheets

(51) Int. Cl.
*B30B 15/24* (2006.01)
*B30B 1/28* (2006.01)

(58) Field of Classification Search
USPC ..... 100/35, 259, 282, 283, 269.13; 72/450
See application file for complete search history.

(56) References Cited

U.S. PATENT DOCUMENTS

| | | | | |
|---|---|---|---|---|
| 5,692,404 | A | 12/1997 | Kirii et al. | |
| 6,535,825 | B1 * | 3/2003 | Okano | B30B 1/265 100/99 |
| 7,102,316 | B2 * | 9/2006 | Beyer | B30B 1/266 100/144 |
| 9,114,583 | B2 * | 8/2015 | Schmeink | B30B 1/26 |
| 2008/0127839 | A1 * | 6/2008 | Fahrenbach | B30B 1/14 100/214 |
| 2010/0206187 | A1 | 8/2010 | Hafner et al. | |
| 2013/0151002 | A1 | 6/2013 | Spiesshofer et al. | |

FOREIGN PATENT DOCUMENTS

| | | | | |
|---|---|---|---|---|
| DE | 41 18 569 | A1 | 12/1992 | |
| DE | 196 42 587 | A1 | 4/1998 | |
| DE | 10 2005 040 263 | A1 | 3/2007 | |
| DE | 10 2006 059 796 | A1 | 6/2008 | |
| EP | 1 240 999 | A1 | 9/2002 | |
| EP | 2 008 799 | A1 | 12/2008 | |
| JP | 3231536 | B2 | 11/2001 | |
| MX | 2013 002164 | | 4/2013 | |
| WO | WO 2007022754 | A1 * | 3/2007 | B30B 15/148 |
| WO | WO 2008071154 | A2 * | 6/2008 | B30B 15/0041 |
| WO | WO 2012/041313 | A2 | 4/2012 | |

* cited by examiner

USING DATA ABOUT THE FORCE FLOW IN A PRESS FOR THE OPERATION OF A RAM

CROSS REFERENCE TO PRIOR APPLICATIONS

This application is a U.S. National Phase application under 35 U.S.C. § 371 of International Application No. PCT/DE2013/100008, filed on Jan. 15, 2013 and which claims benefit to German Patent Application No. 10 2012 100 325.4, filed on Jan. 16, 2012. The International Application was published in German on Jul. 25, 2013 as WO 2013/107444 A1 under PCT Article 21(2).

FIELD

The present invention relates to the use of data about the force flow in a press for the operation of a plunger, wherein the press comprises at least one drive device connected via at least one drive train and generating a force, at least the plunger executing a stroke and transmitting the force and carrying at least one upper tool part and at least one bottom tool part associated with the plunger and the corresponding upper tool part, and wherein a workpiece or material is worked or deformed between the bottom tool part and the upper tool part.

For the purpose of the present invention, generic presses are presses with an upper drive and a bottom drive, but a distinction is made between special applications.

BACKGROUND

Embodiments of such presses with an upper drive and a bottom drive for the plunger have previously been described. For example, the respective element of the drive train connected to and driving the plunger can be designed as a tie rod/connecting rod in a bottom drive or as a threaded spindle in an upper drive or as an element, which directly generates a force such as a piston/cylinder unit.

In presses with a bottom drive, for example, the plunger can thus be driven by a compact drive unit in a sub-structure of the press by way of tie rods—also in conjunction with a connecting rod—or by way of threaded spindles serving as traction elements.

Irrespective of the type of the drive, a tilting of the plunger may occur due to eccentric forces acting during the machining process. Providing a parallel run of the plunger to the sub-structure is, however, often required.

To date, various solutions, which are substantially implemented by appropriate expenses for the drive the plunger or by different embodiments of the plunger guide, are used to achieve a required parallel operation.

It has proven disadvantageous, for example, that a complex but softly reacting kinematic lever system described in AT 215 257 B is inefficient for transmitting eccentric forces. When strong pressing forces are to be transmitted, the relatively numerous mobile machine elements generate only small compensatory movements for an efficient plunger stroke.

Presses (with an upper drive as well as with a bottom drive) must, however, be designed so that they can provide an optimized force and path progression of the plunger and its stroke and can act in a differentiated manner according to machining requirements. Positions of individual machine elements and of the plunger which deviate from normal positions must be absorbed and compensated for as much as possible by the structural system with regard to forces in order to avoid complex embodiments of the plunger guide on the one hand and to provide the machining process on the other hand.

It has already been proposed to record values about operating conditions in the system of the press during machining of the workpiece by means of a control and regulation device and to process them into data according to a function, so that the data is also usable to a limited extent for compensatory movements of the plunger. The press can thus be operated in a controlled or regulated manner according to a system of forces required for machining the workpiece.

In generic presses, the drawing process, e.g., by means of so-called drawing devices and drawing cushions, also has a decisive impact on the positions of the plunger with regard to its horizontal position.

In a punch press described in EP 2 008 799 A1 with a bottom drive, the plunger was driven by way of tie columns (similar to tie rods) by means of a drive mechanism with a crankshaft and connecting rod disposed below the machining level. Bearing loads are here to be reduced by means of a special transmission mechanism and a distribution of the plunger forces and a high precision is to be achieved at high frequencies. Positions of the plunger deviating from the horizontal are not, however, compensable.

With regard to current requirements for presses, wanted or unwanted compensatory movements occurring during the process must be possible. This aims at fulfilling the conditions for a practical operation in order to achieve a synchronous operation or compensatory movements of the plunger during at least a partial segment of its strokes.

In presses with a bottom drive, this thus also applies to the area of the articulation points of the tie rods to the plunger which are often designed as detachable, fixed connections to the plunger.

WO 2012/041313 described, in spite of occurring asymmetrical forces, such as e.g., in a drawing device, securing a guide so as to cause an originally desired movement of the plunger as well as movements of the upper tool part parallel to the bottom tool part, by way of separately operated drive trains having tie rods which independently apply forces to the plunger. Thus, on the one hand, a tilting of the plunger as well as various impacts of the plunger can be avoided and, on the other hand, the tilting of the plunger can be induced in a targeted manner.

It has thus already been proposed to use asymmetrically acting forces of the plunger in an advantageous manner and letting the plunger impact e.g., the drawing cushion device in parallel or, in the absence of a drawing cushion device, to drive the plunger with the upper tool part in parallel so that it bears down onto the bottom tool part. To this end, the e.g., two drive trains must be moved by different distances in the direction of the bottom dead center but without reaching it. A reversal (inversion of the rotational direction of the drive) and an upward movement of the plunger subsequently occur.

As an alternative, one drive train can even move through the bottom dead center and be moved back to the top dead center without a reversal, whereas the other drive train moves back to the top dead center before reaching the bottom dead center by way of a reversal. The respective position of the respective drive train is then decisive for generating the actually acting force.

DE 196 42 587 A1 described a multi-point press with hydraulic pressure pads and inversely adjustable spring stiffnesses of the pressure points for compensating for the tilting of the plunger in order to achieve a parallel positioning of the plunger in presses, which fulfills requirements such as:

reaction to eccentric loads without delay;

precise operation;

strong reliability; and simple, cost-effective structure.

Process disruptions resulting from a tilt of the table relative to the plunger or from eccentric loads on the plunger are therefore to be avoided in mechanically driven multi-point presses with eccentrically running work processes.

An aspect of the present invention is to compensate for the tilting of the plunger so that a plunger movement that is exactly parallel to the press table is for the most part provided.

Therefore, the principle of a solution includes:

a parallel positioning of the plunger in multi-point presses with hydraulic pressure pads, wherein the spring stiffnesses in the pressure points is modified so that different longitudinal deformations of the frame and connecting rod caused by eccentric loads are compensated for by a reduction of the stiffness of the associated pressure pad(s), to this end, the spring stiffness of the pressure points of the press is adjusted so that the total spring stiffnesses of the pressure points, obtained by adding up the spring stiffnesses of the individual pressure pads of the press and the spring stiffnesses of the associated elastically deformed machine parts, and the forces to be transferred by the individual pressure points of the press behave in inverse proportion relative to each other and the less loaded pressure pad(s) is connected to a pressure accumulator, more specifically, a piston accumulator and the preload pressure of the pressure accumulator, more specifically, the gas pressure of the piston accumulator, is adjusted according to the desired reduction of the stiffness of the associated pressure pad.

The problem "tilting of the plunger vs. parallel positioning of the plunger" is only seemingly solved by this synopsis of solutions according to this stage of development.

DE 10 2005 040 263 A1 described the problem of developing a method and a device for controlling and regulating the movement of the plunger in servo-electric presses in order to achieve a precise and repeatable sequence of the movement of the plunger in phases of a position-controlled as well as in phases of a force-controlled movement of the plunger. A controlled operation was meant to provide a high output between several plunger pressure points of one plunger as well as of several plungers of a press line, respectively, relative to each other and relative to peripheral devices.

The control accuracy of the tilt control in highly dynamic processes, usable in case of eccentric forces, of a plunger equipped with several pressure points was also meant to be improved.

In order to regulate the movement of the plunger, the central idea was to combine the principle of a main-shaft-controlled electronic cam disc adjustment with the force adjustment so that, depending on the operation mode, the phases of the movement of the plunger are controlled via electronic position cam discs and via a force adjustment or force limitation.

In addition to a compensation of the variable resiliency of all the drive elements located in the force flow occurring in case of an eccentric load, a tilt control of the individual pressure points was also meant to use the generation of a nominal tilt of the plunger, however, this position control occurred by means of the position cam disc and of a position offset.

From this teaching, the person skilled in the art could indeed gather, on the one hand, the idea of using all the drive elements located in the force flow for compensating the different resiliencies occurring under eccentric loads and, on the other hand, the idea of generating a nominal tilt of the plunger, but always provided that the nominal torques of the servomotors for driving the pressure point(s) of the plunger would be controlled as a function of influencing values such as gear ratio and/or resiliency by means of position cam discs controlled by a virtual main shaft and a force and moment limit value dependent on the operation mode.

Continuing this development, DE 10 2006 059 796 A1 describes a method and a device for controlling and regulating the drive system of a press in which the reproducibility of the quality of the formed parts to be produced is improved in spite of the effects of disruptive influencing values, the service life of the tools is increased, and the productivity is increased while simultaneously reducing the energy consumption.

To this end, the tilt of the plunger is controlled by a preset, servo-driven, position-adjusting device, separately associated with each pressure point. The person skilled in the art already recognized that the asymmetrical spring travels had to be determined by way of the eccentric load specific to each part while taking into account the stiffness model specific to the machine.

The actual compensation of the plunger tilt occurs, however, by way of a relatively complex target/actual comparison of the pre-set asymmetrical adjustment of the position of the plunger and the asymmetrical motion sequence of the servomotors for the main drive additionally associated with the pressure points.

During the 360° cycle mode, an tilting of the plunger at the top dead center is to be avoided according to a second embodiment by respectively traveling through the area of the top dead center in the cycle with a symmetrical adjustment of the position, the asymmetrical position adjustment being reactivated after the top dead center before the subsequent load phase.

In a third embodiment, the regulation of the tilt of the plunger is meant to take place so that during the load phase in the area in front of the bottom dead center, the position of the plunger or upper tool with regard to the tilting and deviation of the bottom dead center is recorded by means of a plunger position measuring device and the tilted position and, if necessary, the immersion depth is influenced in a control circuit.

According to a fourth embodiment, the immersion depth of the plunger is to be controlled. The expected variations of the reversal position of the plunger or tool are here stored in the control unit as a function of influencing values such as temperature changes and stroke rates conditioned by the operating time, while taking into account a model specific to the machine.

The central idea of these solutions is to influence, in a servo-electric forming press, the positional deviations of a plunger, drivable by means of a crank or a lever, caused by external and internal influencing values in a stroke-dependent operating mode when passing through the bottom dead center so that the immersion depth and the tilted position of the plunger is controllable or adjustable. However, using the cam disc regulation to control the servomotors for the main drive, which require separate electronic cam discs for each drive associated with each pressure point, is common to all four embodiments.

The person skilled in the art can see that the behavior of these presses is influenced in relation to a pre-set virtual main shaft, wherein the deviation of the individual servomotors from the pre-set main shaft position is to be influenced. This requires various preparation phases, which require a complex sequence for achieving a corresponding setting of the machine.

In view of these analyses, the problem of allowing the asymmetrically occurring press forces as well as drawing cushion forces to cause an unwanted tilting of the plunger such as caused by a malfunction or of counteracting it or of initiating a desired tilting of the plunger with simpler means such as available structural components, i.e., providing a desired parallel movement of the plunger by means of controlled and regulated drive motors, still remains.

A further development aiming at associating a cam disc regulation, with separate electronic cam discs for each drive, to the main drive is therefore ruled out.

The objective impact of Hooke's law in the constructional system of a press, according to which a tilting of the plunger due to eccentric forces generates different loads on the parts located in the force flow, which expand or compress or move differently according to Hooke's law as a function of the acting force, must therefore be more deliberately taken into account, amongst others, because complex structural additions can have a disadvantageous impact on the entire system.

The solution described by DE 196 42 587 A1 disadvantageously shows the person skilled in the art that it is only usable in a press that is driven by way of one drive and that the drive is distributed to several pressure points through a power distribution. It is thus not possible to influence the uniform or non-uniform forming process in any way by way of a control or adjustment of the drive.

Apart from these proposed solutions, sliding guides, for example, which are not adjustable or only adjustable along several axes, have been used for compensatory movements in presses. Complex rolling guides (roller bearing guides) are alternately also used, even in an elaborately pre-loaded state.

In order to prevent damage to these technical mechanisms in case of unexpected operating states, very complex protection mechanisms are therefore sometimes installed for preventing overloads.

The invention assumes that all these expenses and devices, such as guide and protection devices, can be dispensed with if the desired parallel movement of the plunger can be provided by controlled and regulated drive motors. In case of malfunctions, it must also be possible to allow a tilting or inclination of the plunger. Until now, solutions to this effect have not been covered by current developments and have been virtually excluded.

At the same time, the problem emerges of initiating a deviation from the desired parallel movement of the plunger, such as a tilting or inclination in a targeted manner, if expedient for the process, and of inducing such positions of the plunger by means of elements of the drives.

SUMMARY

An aspect of the present invention is to allow or counteract, in a press of the types described in the introduction, i.e., in presses with a top drive as well as presses with a bottom drive, an unwanted tilting of the plunger, such as caused by a malfunction, in case of asymmetrically occurring press forces as well as drawing cushion forces, or to trigger a desired tilting of the plunger by means of structural components, to which end data about the force flow in a press must be used for operating the plunger, without using complex protection mechanisms.

In an embodiment, the present invention provides a method of using data on a force flow in a press to operate a plunger, the method comprising providing the press. The press comprises a substructure. At least one drive device is arranged in the substructure. The at least one drive device is operatively connected to at least one drive train so as to generate a force. A plunger comprising at least one upper tool part is configured to execute a stroke and to transmit the force. At least one bottom tool part is associated with the plunger and with the at least one upper tool part. At least one traction element or pressure element is configured to act on the plunger via a traction connection or pressure connection which is configured to transmit a drive for the stroke of the plunger. The at least one traction element or pressure element and the traction connection or pressure connection is configured to produce a force flow from the drive device to the at least one upper tool part. The traction connection or pressure element and the at least one traction element or pressure element is mounted on the plunger in a traction/pressure point so as to allow for a tilting of the plunger. The traction/pressure point, due to elasticities of at least one traction element or pressure element, is configured to allow for a modifiable position which allows for a detachable configuration, a permanent configuration, or a fixed configuration of the traction connection or pressure connection. A workpiece or a material is worked or deformed between the at least one upper tool part and the at least one bottom tool part by the plunger and the at least one upper tool part being driven between a top and a bottom dead center in at least one single reversing stroke or in strokes passing through the bottom dead center and a top dead center so as to bear down onto the bottom tool part. Data on the force flow acting on and leading to an expansion, a compression, or a movement in an area of the traction/pressure point or of at least one traction element or pressure element in relation to the at least one drive device and a position of the plunger is recorded and analyzed so as to allow, counteract or initiate a tilting of the plunger for an operation of the press.

BRIEF DESCRIPTION OF THE DRAWINGS

The present invention is described in greater detail below on the basis of embodiments and of the drawings in which.

DETAILED DESCRIPTION

Figure 1:
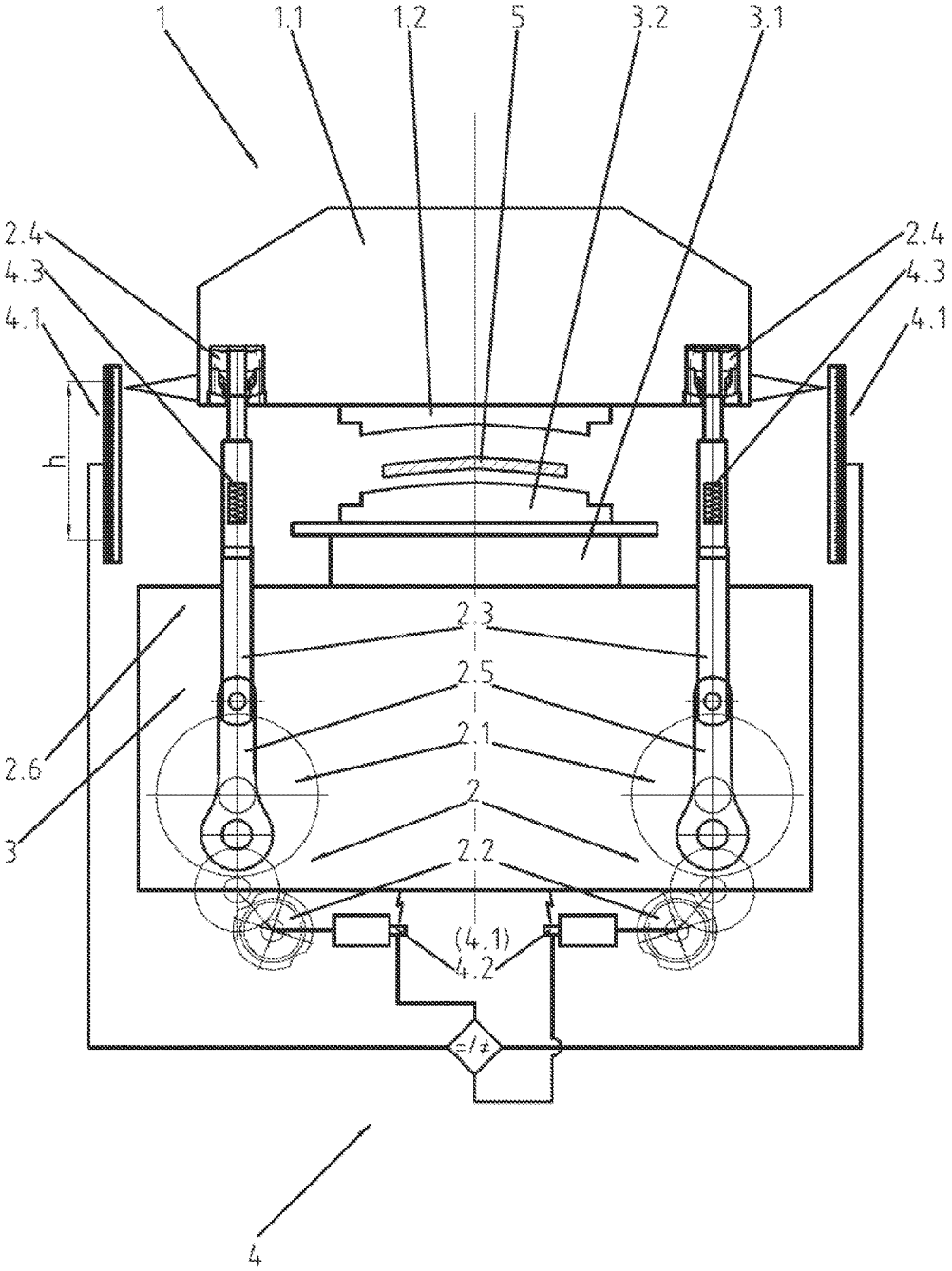
FIG. 1 shows a simplified representation of the press 1 with a bottom drive and a tie rod connection 2.4.1 and the schematic operation principle by means of a control and regulation device 4 as well as the means 4.1, 4.2, 4.3.
Figure 2:
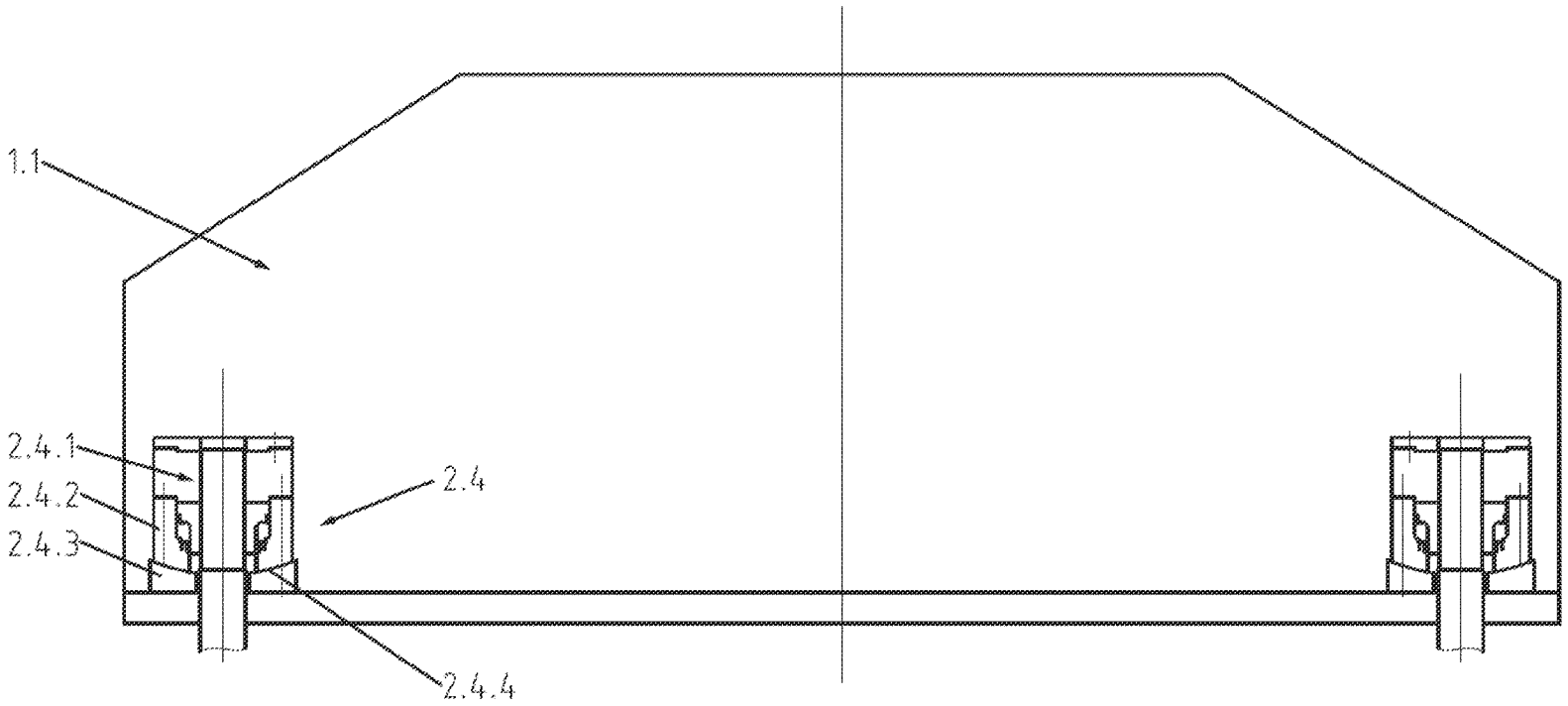
FIG. 2 shows details of the tie rod connection 2.4.1 with the convex spherical segment bearings 2.4.2 and concave spherical segment bearings 2.4.3 in which each tie rod 2.1.2 is borne on the plunger 1.1 in a pressure point 2.4.

In the present invention addresses these aspects based on the action of Hooke's law in the structural system of a press. According thereto, a tilting of the plunger caused by eccentric forces generates different loads acting on the parts located in the force flow which expand or compress or move according to Hooke's law as a function of the acting force.

Until now, such forces acting on components of the press were already being recorded and analyzed, but only for an immediate monitoring of the forming process of the workpiece between the upper tool part and the bottom tool part and in order to control excessive loads/loads with regard to the loads acting on the press and the tools.

The present invention discloses two embodiments, while taking into account that a looming tilting of the plunger due to eccentric forces causes different loads on the parts located in the force flow, which, according to Hooke's law, expand, compress, or move differently as a function of the acting force.

A first embodiment of the present invention additionally uses the data about these different expansions, compressions, or movements of the components and of the press in the force flow of the press for operating a plunger, wherein the press comprises at least one drive device connected via at least one drive train and generating a force, at least the plunger executing a stroke and transmitting the force and carrying at least one upper tool part, and at least one bottom tool part associated with the plunger and the corresponding upper tool part, said parts of the press producing the force flow from the drive device to the upper tool part, wherein a workpiece or material is worked or deformed between the upper tool part and the bottom tool part, and the plunger with the upper tool part is driven between a top and a bottom dead center in at least one single reversing stroke or in strokes passing through the bottom dead center and the top dead center so that it bears down onto the bottom tool part, so that the data about different loads caused by eccentric forces acting on the entire force flow or an all the parts involved in the force flow, said forces causing an expansion or compression or movement of the involved parts according to Hooke's law, is recorded and analyzed in relation to the drive device (2) and to the position of the plunger (1.1), whereupon, a tilting of the plunger (1.1) is allowed, or a tilting of the plunger (1.1) is counteracted, or a tilting of the plunger (1.1) is initiated, for operation.

As opposed in particular to DE 196 42 587 A1, the present invention achieved that generic presses can be operated by way of two drive units. It is thus possible to influence the synchronous operation of the plunger by means of a control and regulation of the drives. Data about both drives can here be recorded in order to derive decision criteria for the control and regulation process, wherein all the components or drives involved in the force flow are taken into account.

A second embodiment of the present invention uses the data about the force flow of a press for the operation of a plunger, wherein the press comprises at least one drive device disposed in a sub-structure and connected via at least one drive train and generating a force, at least the plunger executing a stroke and transmitting the force and carrying at least one upper tool part, and at least one traction element or pressure element acting on the plunger by means of a traction connection or pressure connection for transmitting the drive for the stroke of the plunger, and at least one bottom tool part associated with the plunger and the corresponding upper tool part, said parts of the press producing the force flow from the drive device to the upper tool part, wherein a workpiece or material is worked or deformed between the upper tool part and the bottom tool part, and the plunger with the upper tool part is driven between a top and a bottom dead center in at least one single reversing stroke or in strokes passing through the bottom dead center and the top dead center so that it bears down onto the bottom tool part, so that the traction connection with the traction element or the pressure connection with the pressure element is mounted on the plunger in a traction/pressure point allowing for a tilting of the plunger, data about the force flow acting there and leading to an expansion or a compression or a movement in the area of the traction/pressure point or of the traction element or the pressure element is recorded and analyzed in relation to the drive device and the position of the plunger, whereupon, a tilting of the plunger (1.1) is allowed, or a tilting of the plunger (1.1) is counteracted, or a tilting of the plunger (1.1) is initiated, for operation.

In an embodiment of the present invention, the traction element can, for example, be configured as a tie rod or feed rod. In an embodiment of the present invention, the pressure element can, for example, be configured as a connecting rod or a shaft or a piston/cylinder unit.

In an embodiment of the present invention, an arrangement of the traction connection or of the pressure connection can, for example, advantageously be used for the second embodiment in the traction/pressure point, each having a convex spherical segment bearing and a concave spherical segment bearing corresponding to each other in the manner of a calotte and allowing for an articulately changeable bearing of the traction element or pressure element, wherein compensatory forces/movements are absorbed by the spherical segment bearings.

In an embodiment of the present invention, a detachable or permanent or fixed arrangement of the traction connection or of the pressure connection can, for example, be alternately used in the traction/pressure point, which allows a modifiable position due to acceptable resiliencies of the traction element or pressure element, wherein compensatory forces/movements are then elastically absorbed by the traction element or the pressure element.

In an embodiment of the present invention, the data can, for example, be analysed in a relation according to Hooke's function $F=D\times\Delta$, wherein F refers to the force, D to a spring constant, and $\Delta$ is the distance of expansion or compression.

In an embodiment of the present invention, at least one first means can, for example, be used for recording data about a displacement or the stroke with regard to the position of the plunger.

In an embodiment of the present invention, at least one second means can, for example, be provided for analyzing data about at least one of the states or one of the functions such as:

the position of the plunger, the force flow of the involved parts, for a targeted tilting of the plunger.

In an embodiment of the present invention, at least one third means can, for example, be responsible only for recording data about the force flow of the involved parts.

In an embodiment of the present invention, in order to record the data about parts subjected to an expansion or a compression or a movement, at least one element recording a force or movement can, for example, be provided in at least one part of the press, wherein said element can, for example, be fastened in the force- or movement-sensitive areas of the expansion or compression or articulately modifiable bearing of the traction element or pressure element and is configured as a piezo-element, a strain gauge or a similarly acting element.

In an embodiment of the present invention, a control and regulation device can, for example, process the data of the first, second and third means for at least one of the control signals such as:

allowing a tilting of the plunger,
counteracting a tilting of the plunger, or
initiating a tilting of the plunger,
for operating the plunger.

In an embodiment of the present invention, an integration of at least the first means or the second means or the third means can, for example, take place for a controlled or regulated process sequence, wherein a relation is established between the data about occurring deformation forces processed by the second means or third means and the data about the position of the plunger detected by the first means or the second means.

In an embodiment of the present invention, the data detected by the second means or the third means and the data about the position of the plunger detected by first means can, for example, be controlled/regulated as reference values in the process operation in such a manner that the desired force flow/force compensation is implemented.

In an embodiment of the present invention, the detected data about the position of the plunger can, for example, also be provided as reference values, according to which the desired force flow/force compensation is adjusted.

In an embodiment of the present invention, the reference values based on the detected data about the force flow of the involved parts or the deformation forces and the reference values based on the detected data about the position of the plunger can, for example, be changed during the process operation.

In an embodiment of the present invention, the data resulting from the forces or positions of the plunger, which respectively change during the process, can, for example, be processed by at least one of the first, second and third means.

As a whole, the present invention establishes a relation between the respective drive devices and the monitored position of the plunger based on this data, analyses this relation, and can influence a tilting of the plunger in a targeted manner in spite of different forces and thus different compressions of the components, so that a tilting of the plunger is deliberately allowed or counteracted or initiated in the operation.

The present invention therefore provides a solution that is respectively useful for a targeted tilting of the plunger or for a tilting of the plunger that is to be accepted as well as for one that results from a malfunction.

The present invention is thus applicable in presses with a top drive as well as for presses with a bottom drive, wherein "quasi-sensory means" for recording data about the parts involved in the force flow can be parts, that can, for example, be located in areas that are relevant to the force flow and sensitive to the components, such as e.g., a pressure or traction connection (respectively in a top or bottom drive) with the plunger.

In a press with a bottom drive, it can, for example, be advantageous to provide an arrangement of the traction connection in the traction/pressure point having a convex spherical segment bearing and a concave spherical segment bearing corresponding to each other in the manner of a calotte.

This arrangement of the traction connection in the traction/pressure point having a convex spherical segment bearing and a concave spherical segment bearing corresponding to each other in the manner of a calotte can, however, also be used as a pressure connection in a press with a top drive.

This structure according to the invention can be implemented e.g., in a generic press with a bottom drive as described in PCT/DE2011/075197, which already uses data for a force-optimized process operation.

However, to date, this data merely relates to:

a course or a position in the stroke of the plunger,
an actual value of a force or a force-equivalent value in at least one of the drive elements of the drive device,
values of a power consumption, a torque, an electric current, a rotational speed or a rotation angle of at least one drive element such as a motor or servomotor,
an actual value of an output or output increase in the system of the press, which are functionally processed in a control and regulation device, e.g., for modifying values that are to be adjusted or set for operating the press,
for overload protection, emergency operation or shutdown of the press and/or
for a synchronous or asynchronous run of drive elements of the drive device
for operating the press.

The present invention can be integrated into this prepared system with a marginal effort so that it is technologically easily implementable.

If the present invention is used, the area of the tie rod connection with the plunger, i.e., the traction/pressure point used as a "quasi-sensory means", can, for example, be equipped with strain gauges or piezo-elements for recording the data.

In this regard, the development according to the present invention, namely the control and regulation device protecting the mechanical structure of the press and providing the compensation of asymmetrical press forces as well as processing data from the first, second and third means, is also insertable into an existing system configured as proposed above.

A controlled or regulated process sequence can thus be defined, for example, during forming by taking into account at least the first means or the second means or the third means. In doing so, a relation is established between the data about occurring forming forces processed by the second means or third means and the data about the position of the plunger detected by the first means or the second means.

In view of the issue presented above, the teaching according to the present invention also allows initiating asymmetrical press forces and drawing cushion forces in a targeted manner, for example, in a press with a bottom drive, by way of tie rods not rigidly connected with the plunger in four pressure points, the possible movable bearing in respectively one calotte and the definable tilting of the plunger also serving to this end.

In general, in generic presses, regardless of whether it has a top drive or a bottom drive, once the upper tool part has borne down on e.g., a workpiece holder of e.g., a drawing cushion, or after the plunger as borne down on the bottom tool part, the different forces resulting from the tilting will be easier to adjust in the press of the machine by means of the present invention, according to the rotational angle of the eccentric and the spring constant, i.e., according to Hooke's law.

In particular in a press with a bottom drive implemented as described, for example, in PCT/DE2011/075197, pressure points as well as, according to a kinematic reversal, traction points act on the tie rod connections used therein, which is why this area of the tie rod connections is referred to as "traction/pressure points" herein. Indeed, according to the present invention, the force application occurring there has different causes, namely, an oblique or inclined position of the plunger caused by a malfunction of the press or controlled in a targeted manner. For both causes, the present invention provides a uniformly effective advantage regarding elements such as the guide, the adjusting mechanism of the plunger and the overload protection. Since the application of a force on the pressure point can come e.g., from a connecting rod disposed above it (as in a press with a top drive) and the press force is transmitted via e.g., a transverse bolt to a threaded spindle, which is part of a pressure point, the length of said threaded spindle would be decisive for a potential adjustment of the plunger. A necessary consequence of this arrangement determined by the geometry of the press would be that the length of the spindles and thus the height of the plunger adjusting mechanism would be disadvantageous to the height of the press. In contrast, by using a traction point in combination with a pressure point, this disadvantage of having to factor the spindle length into the height of the entire machine can be eliminated a priori by the use according to the present invention and the tilt or tilting of the plunger, e.g., initiated in a targeted manner, can be additionally controlled to an almost unlimited extent.

In this regard, the present invention provides an additional effect which has an impact not only on the interaction of the deformation forces as well as the drawing cushion forces but also advantageously on the structural complexity of generic presses and more specifically on an optimized design of the hydraulic components when using a drawing cushion.

The principle of the present invention can therefore also be integrated or retrofitted with little effort into available control and regulation systems of the involved drives.

The present invention is hereafter described based on an exemplary embodiment, for example, in a press with a bottom drive, by means of the drawings.

FIG. 1 shows a press 1 with a bottom drive, whose drive device 2 disposed in a sub-structure 3 comprises eccentric drive elements 2.1, motors or servomotors 2.2, tie rods 2.3 and connecting rods 2.5. A plunger 1.1 executing a stroke h between a top dead center (not labeled) and a bottom dead center (not labeled) has an upper tool part 1.2. Two pairs of tie rods 2.3 and connecting rods 2.5 as part of a drive train 2.6 act on the plunger 1.1, respectively, in the area of a traction/pressure point 2.4 for transmitting the drive for the stroke h of the plunger 1.1. The plunger 1.1 with the upper tool part 1.2 corresponds to a bottom tool part 3.2 disposed on the substructure 3, wherein the upper tool part 1.2 acts onto a workpiece 5 located on the bottom tool part 3.2 for forming. The bottom tool part 3.2 is disposed on a table 3.1 belonging to the substructure 3.

A control and regulation device 4, whose operation can be designed according to the system described in PCT/DE2011/075197, is provided for operating the press 1. By way of the tie rods 2.3 and the connecting rod 2.5, forces acting in a differentiated manner are applied to the workpiece 5 to be formed between the upper tool part 1.2 and the bottom tool part 3.2 so that the press 1 can be permanently operated according to a system of forces required exclusively by the workpiece 5, but still without the use of a traction connection 2.4.1 disclosed according to the invention.

The press 1 operating according to that system takes sequences into consideration, in terms of control, which are usable for the new inventive process according to the features disclosed in the claims on the one hand and which transcend them in terms of their effects.

This proposed control solution and the complex operational and constructional design required for it can be assisted on the one hand by generating the force actually acting in each respective position of the respective drive train 2.6 or of e.g., an eccentric drive element 2.1 of the drive device 2 and on the other hand by using the data in consideration of Hooke's law in accordance with the invention.

Based on a press 1 designed in such a manner, the present invention goes beyond that and solves the issue presented in the introduction and the problem of tilted or inclined positions of the plunger, i.e., when the position of the plunger 1.1 deviates from a normal parallel operation, in accordance with the following new example.

A force compensation caused by opposing, returning forces (Hooke's law) countering the deformations initiated in the constructional system of the press 1 by the asymmetrically acting forces is initiated by an interaction between the involved deformation forces, a rotation angle and a spring constant or at least respectively one of these dimensions of at least one machine element of the press 1 in relation with its constructional stiffness or of an eccentric element of the drive device 2.

To this end, the traction connection 2.4.1 non-rigidly borne in a traction/pressure point 2.4 allowing a modifiable position between the plunger 1.1 and the tie rod 2.3 is used, which means that this area is used as a "quasi-sensory means" and is re-constructed in a surprisingly functional new manner.

It is alternately possible to choose an arrangement of the traction connection 2.4.1 that is rigid due to acceptable elasticities.

Whether the tilted or inclined position of the plunger 1.1 is caused by a malfunction of the press 1 or is initiated in a targeted manner, the force compensation is respectively supported, optimized or implemented by means of data to be recorded or to be input in the area of the traction/pressure point 2.4. To this end, the non-rigid traction connection 2.4.1 is borne in the traction/pressure point 2.4 in an arrangement having, respectively, one convex spherical segment bearing 2.4.2 and one concave spherical segment bearing 2.4.3 corresponding to each other in the manner of a calotte.

If the tilted or inclined position of the plunger 1.1 is caused by a malfunction of the press 1, a first means 4.1 records the data about this position of the plunger 1.1, which is input in order to support the force compensation and to preserve the operation of the construction system of the press 1.

If the tilted or inclined position of the plunger 1.1 is to be controlled in a targeted manner, a second means 4.2 provides the data for this desired position of the plunger 1.1, whereby, a resulting unequal movement of the two drive trains 2.6 is continued, e.g., after the upper tool part 1.2 has borne down onto the bottom tool part 3.2. The upper tool part 1.2 and the bottom tool part 3.2 are now closable in a parallel relation, wherein asymmetrical and unequally acting forces are generated in a targeted manner by the unequally continuing movement and the spring stiffness of the press 1.

In this example, third means 4.3 provide for a recording of data about the force flow by way of a force/displacement recording mean 2.4.4.

The control and regulation device 4 provided for operating the press 1 processes the data from the first, second and third means 4.1, 4.2, 4.3 for protecting the mechanical structure of the press and for a compensation of the asymmetrical press forces and provides control signals such as:

allowing a tilting of the plunger, or counteracting a tilting of the plunger, or initiating a tilting of the plunger.

During forming, the third means 4.3 thus establishes and adjusts a relation between the occurring forces (deformation forces) in the force flow and the position of the plunger 1.1 based on the data about the traction/pressure point 2.4, respectively, from the first means 4.1 in case of a malfunction of the press 1 or from the second means 4.2 in case of a tilted or inclined position of the plunger 1.1 initiated in a targeted manner.

The data obtained from the respective deformation force is then used as a reference value and the position of the plunger 1.1 is guided so that a desired force flow is implemented. The force compensation preserving the constructional system of the press 1 is thus optimized or carried out.

Data gathered from the position of the plunger 1.1 can also play a decisive role as reference values.

The force compensation controlled in such a manner during the forming process based on the data detected in the traction/pressure point 2.4 by means of the "quasi-sensory means" also considers the fact that the respective forces or positions of the plunger 1.2 change and that the respective reference values derived from the force or the position of the plunger 1.1 can vary.

Known force/displacement recording means 2.4.4 such as strain gauges or piezo-elements or similarly acting means, which can be chosen by the person skilled in the art in the usual manner, can be used for recording the data in the area of the traction/pressure point 2.4.

The design of the first, second and third means 4.1, 4.2, 4.3 is also chosen by the person skilled in the art in a customary manner and does not have to be described in more detail herein.

The principle according to the invention is also applicable in a press with a top drive, not explained here, in which the force flow occurs from a drive device disposed at the top via a plunger with an upper tool part to a bottom tool part by way of a pressure connection. The plunger with the upper tool part can here too be moved between a top and a bottom dead center in at least one single reversing stroke or in strokes passing through the bottom dead center and the top dead center, so that it bears down on the bottom tool part.

The use of data about the force flow in that press for operating a plunger occurs so that in case of a tilting of the plunger caused by eccentric forces and of different resulting loads on the parts involved in the force flow, which are also subject to an expansion or a compression as a function of the respectively acting force according to Hooke's law, the data is recorded and analysed in relation to the drive device and the position of the plunger, whereupon:

a tilting of the plunger is allowed, or a tilting of the plunger is counteracted, or a tilting of the plunger is initiated.

In an application according to the present invention, the parts involved in the force flow can be connecting rods or spindles, which act on the plunger in a pressure point and which are connected in that point with the plunger. In the area of said pressure point, similar force/displacement recording means 2.4.4, such as strain gauges or piezo-elements or similarly acting means, are used for recording the data about the force flow.

The use of data in a press according to the invention can be implemented on the one hand in existing basic systems without a substantial construction effort on the one hand and ensure on the other hand:

an allowable tilting, or a counteraction of the tilting, or a targeted initiation of a tilting, of the plunger and supports the efficiency of acting forces for an energy-saving operation of any generic press.

The present invention is not limited to embodiments described herein; reference should be had to the appended claims.

LIST OF REFERENCE NUMBERS

1 press
1.1 plunger
1.2 upper tool part
2 drive device
2.1 eccentric drive element
2.2 motor or servomotor
2.3 traction element, tie rod, feed rod (bottom drive), pressure element, spindle, piston/cylinder unit (top drive)
2.4 traction/pressure point
2.4.1 traction connection (bottom drive), pressure connection (top drive)
2.4.2 convex spherical segment bearing
2.4.3 concave spherical segment bearing
2.4.4 force/displacement recording means
2.5 connecting rod
2.6 drive train
3 substructure
3.1 table
3.2 bottom tool part
4 control and regulation device
4.1 first means for recording data about the position of the plunger (1.1)
4.2 second means for recording data
4.3 third means for recording data about the force flow
5 workpiece
h stroke

What is claimed is:

1. A method of using data on a force flow in a press to operate a plunger, the method comprising:

providing the press comprising:

a substructure, at least one drive device arranged in the substructure, the at least one drive device being operatively connected to at least one drive train so as to generate a force, a plunger comprising at least one upper tool part, the plunger being configured to execute a stroke and to transmit the force, at least one bottom tool part associated with the plunger and with the at least one upper tool part, the at least one bottom tool part being arranged to the substructure, at least one traction element or pressure element configured to act on the plunger via a traction connection or pressure connection which is configured to transmit a drive for the stroke of the plunger, the at least one traction element or pressure element and the traction connection or pressure connection being configured to produce a force flow from the drive device to the at least one upper tool part, a traction point and/or pressure point, the traction connection or pressure connection and the at least one traction element or pressure element being mounted on the plunger in the traction point and/or pressure point so as to allow for a tilting of the plunger, the traction point and/or pressure point, due to elasticities of at least one traction element or pressure element, being configured to allow for a modifiable position between the plunger and the traction element or pressure element, at least one displacement/stroke measurement device configured to record data on a displacement or the stroke with regard to the position of the plunger, at least one data recording device configured to record data on at least one of a state or a function relating to, the position of the plunger, the force flow, and a targeted tilting of the plunger, at least one force flow measuring device configured to record data on the force flow, and a control and regulation device configured to process the data from the at least one displacement/stroke measurement device, the at least one data recording device, and the at least one force flow measuring device;

providing a workpiece or a material;

working or deforming the workpiece or the material between the at least one upper tool part and the at least one bottom tool part and the plunger with the at least one upper tool part being driven between a top and a bottom dead center in at least one single reversing stroke or in strokes passing through the bottom dead center and a top dead center so as to bear down onto the bottom tool part; and applying the data processed by the control and regulation device on the force flow acting on and leading to an expansion, a compression, or a movement in an area of the traction point and/or pressure point or of at least one traction element or pressure element in relation to the at least one drive device and a position of the plunger so as to allow, counteract or initiate a tilting of the plunger during an operation of the plunger.

2. The method as recited in claim 1, wherein at least one traction element or pressure element is provided as a tie rod, a feed rod, a connecting rod, a spindle, or a piston/cylinder unit.

3. The method as recited in claim 1, wherein the press further comprises a convex spherical segment bearing and a concave spherical segment bearing which are configured to correspond with each other in a manner of a calotte, wherein the traction connection or pressure connection in the traction point and/or pressure point is arranged with the convex spherical segment bearing and the concave spherical segment bearing so as to allow for an articulately changeable bearing of the at least one traction element or pressure element.

4. The method as recited in claim 1, wherein the processing of the data by the control and regulation device is performed based on a relation according to Hooke's function $F=D\times\Delta$.

5. The method as recited in claim 1, wherein the press further comprises at least one force-recording or displacement-recording element.

6. The method as recited in claim 1, further comprising:

using at least the at least one displacement/stroke measurement device, or the at least one data recording device, or the at least one force flow measuring device for a controlled or regulated process sequence; and establishing a relation between data on occurring deformation forces processed by the at least one data recording device or by the at least one force flow measuring device, and data on the position of the plunger detected by the at least one displacement/stroke measurement device or the at least one data recording device.

7. The method as recited in claim 1, further comprising:

controlling/regulating data detected by the at least one data recording device or by the at least one force flow measuring device, and data on the position of the plunger detected by the at least one displacement/stroke measurement device as reference values so as to implement a desired force flow/force compensation in a process operation.

8. The method as recited in claim 7, wherein, in the process operation, the process further comprises:

providing the data detected on the position of the plunger as reference values; and adjusting a desired force flow/force compensation based on the reference values.

9. The method as recited in claim 7, further comprising:

changing the reference values based on the data detected on the force flow or on the deformation forces, and the reference values based on the data detected on the position of the plunger during the process operation.

10. The method as recited in claim 9, further comprising:

processing the data resulting from the force flow or from the position of the plunger, which respectively change during the process operation, via at least one of the at least one displacement/stroke measurement device, the at least one data recording device, and the at least one force flow measuring device.

* * * * *